US007703157B2

(12) United States Patent
Dorenbeck

(10) Patent No.: US 7,703,157 B2
(45) Date of Patent: Apr. 27, 2010

(54) BED, IN PARTICULAR SICKBED OR NURSING BED

(75) Inventor: Günther Dorenbeck, Wetter (DE)

(73) Assignee: Völker AG, Witten (DE)

( * ) Notice: Subject to any disclaimer, the term of this patent is extended or adjusted under 35 U.S.C. 154(b) by 507 days.

(21) Appl. No.: 11/703,534

(22) Filed: Feb. 7, 2007

(65) Prior Publication Data

US 2007/0226907 A1 Oct. 4, 2007

(30) Foreign Application Priority Data

Feb. 11, 2006 (DE) ..... 10 2006 006 317

(51) Int. Cl.
*A61G 7/10* (2006.01)

(52) U.S. Cl. ..... 5/611; 5/11; 5/86.1

(58) Field of Classification Search ..... 5/611, 5/11, 86.1, 509.1; 16/34, 35 R; 296/20; 280/43.24
See application file for complete search history.

(56) References Cited

U.S. PATENT DOCUMENTS

| | | | | |
|---|---|---|---|---|
| 6,601,251 | B2 * | 8/2003 | Paul | 5/611 |
| 6,920,656 | B2 * | 7/2005 | Roussy | 5/611 |
| 7,013,510 | B1 * | 3/2006 | Johnson | 5/611 |
| 7,185,377 | B2 * | 3/2007 | Roussy | 5/611 |
| 7,509,697 | B2 * | 3/2009 | Dorenbeck | 5/611 |
| 2007/0083992 | A1 * | 4/2007 | Lindner et al. | 5/611 |

FOREIGN PATENT DOCUMENTS

| | | |
|---|---|---|
| DE | 43 20 092 | 12/1993 |
| DE | 44 06 784 | 8/1995 |
| DE | 199 15 431 | 10/2000 |

* cited by examiner

*Primary Examiner*—Michael Trettel
(74) *Attorney, Agent, or Firm*—Shumaker & Sieffert, P.A.

(57) ABSTRACT

A bed, in particular a sickbed or nursing bed, comprises a height-adjustable bedstead to be supported on a floor, a fixing brake having an actuator adapted to be moved between a braking position and a release position and to be operated by hand or by foot, and at least one brake element which is pressed to the floor in the braking position of the actuator, and is spaced apart from the floor in the release position of the actuator. The actuator is adapted to be automatically placed into the brake position by a bedstead element when the lowermost position of the bedstead has been reached.

6 Claims, 4 Drawing Sheets

BED, IN PARTICULAR SICKBED OR NURSING BED

The present application claims the priority of German Patent Application No. 10 2006 006 317.1, filed Feb. 11, 2006, the entire disclosure of which is incorporated herein by reference.

BACKGROUND OF THE INVENTION

1. Field of the Invention

The invention relates to a bed which is in particular a sickbed or a nursing bed.

2. Description of Related Art

Sickbeds or nursing beds are normally height-adjustable for making it easier for nursing staff to nurse a patient or a test person. Such beds normally comprise side parts on both sides of a lying surface, said side parts being adapted to prevent the test person from falling out of the bed.

It is known that, depending on their mental or physical condition, the test persons try to climb over the side parts in order to leave the bed. In doing so, the test persons may fall when climbing over the side parts, which entails a considerable risk of injury.

Thus it is desirable that a sickbed or nursing bed can be lowered to such an extent that the upper edges of the side parts are located at a height where there is only a small risk of injury for a test person climbing over the side bars. Ideally, the bed can be lowered to such an extent that its lying surface is located only a few centimeters (20 to 30 cm, for example) above a floor. At such a low position, a side protection can even be omitted since there is hardly any risk of injury if a test persons "falls" out of the bed from a height of only a few centimeters.

It is common practice to realize height-adjustable bedsteads of sickbeds or nursing beds either by telescoping or length-adjustable vertical legs or by so-called scissor-type mechanisms. The scissor-type mechanisms offer the advantage that the beds can be lowered to an extremely low level. Examples of scissor-type mechanisms for height-adjustable bedsteads are shown in DE 43 20 092 A1, DE 44 06 784 C1 and DE 199 15 431 A1. The known height-adjustable beds having a scissor-type mechanism or scissor levers comprise a frame having frame side and frame transverse parts, wherein pivotable legs are arranged at the head end and the foot end of the frame. The legs comprise lower ends supported on the floor, while their opposite ends are slidably guided along the frame. The legs are adapted to be pivoted via a centrally arranged drive mechanism such that the bedstead is lifted or lowered.

For further increasing the comfort, sickbeds or nursing beds comprise adjustable lying surfaces, i.e. adjustable mattress supporting devices. These devices comprise individually adjustable or pivotable portions which are adapted to be adjusted by a motor. An adjustment drive is located below the lying surface or the mattress supporting surface of the mattress supporting device. The height-adjustable bedstead of the sickbed or nursing bed may not collide with this adjustment drive, which means that the bed can be lowered only to a position in which the lying surface is located at such a height above the floor that a side protection cannot be omitted. In other words, the adjustment drive thus prevents sickbeds or nursing beds equipped with a scissor-type mechanism or a similar height adjustment means from being lowered down to a location as near to the floor as possible.

Sickbeds or nursing beds further comprise a fixing brake for locking the bed in position with the purpose of preventing any unintentional movement of the beds which are normally provided with guide rollers and castors. Normally, such fixing brakes are adapted to be operated by hand or by foot. This involves the risk that the nursing staff unintentionally do not operate the fixing brake of the sickbed or the nursing bed when the bed is being lowered or is completely lowered. Thus the bed can inadvertently move which entails a risk of injury of the patients or test persons on the one hand, and the risk of damage to functional units of the bed on the other hand since there is only little space between the functional units and the floor in the completely lowered condition.

SUMMARY OF THE INVENTION

It is an object of the invention to provide a bed, in particular a sickbed or nursing bed, which is height-adjustable, and wherein the risk of an unintentional movement of the bed across a floor is prevented when the bed is in the lowered condition.

For achieving this object, the invention proposes a bed, in particular a sickbed or nursing bed, which comprises

- a height-adjustable bedstead to be supported on the floor,
- a fixing brake comprising an actuator adapted to be moved between a braking position and a release position and to be operated by hand or by foot, and at least one brake element which is pressed to the floor in the braking position of the actuator, and is spaced apart from the floor in the release position of the actuator,
- wherein the actuator is adapted to be automatically placed into the brake position by a bedstead element when the lowermost position of the bedstead has been reached.

The bed according to the invention comprises a fixing brake which is automatically operated when the bed is in its lowermost position. According to the invention, this is realized in that the hand- or foot-operated actuator of the fixing brake is placed into the braking position by an element of the height-adjustable bedstead when the bed has reached its lowermost position.

The system according to the invention offers the advantage that one and the same brake can be used for locking the bed both in the lifted position in which the fixing brake can be operated by hand or by foot, and in the lowermost position in which the fixing brake is automatically operated. Here, the actuator of the fixing brake can be continued to be operated by hand or by foot for the purpose of increasing the pressure force of the brake element, with the brake element then automatically remaining in this position.

According to an advantageous embodiment of the invention, the bedstead comprises a frame and length-adjustable and/or pivotable legs supported at said frame, wherein the at least one brake element is arranged at least one of the legs or between two legs, and wherein the actuator, in its release position, extends into the path along which an element of the bedstead moves when the bedstead is lowered into the lowermost position. Here, the actuator may be adapted to be continued to be operated in the lowermost position of the bedstead for the purpose of even more strongly press the brake element to the floor.

Finally, it is appropriate when the bedstead comprises castors and at least one of the castors is lifted with respect to the floor when the brake element is pressed to the floor. Further, it may be advantageous when the actuator is configured as part of a knee lever mechanism via which the brake element is pressed to the floor und then automatically remains in this position.

BRIEF DESCRIPTION OF THE DRAWINGS

An embodiment of the invention will now be described in greater detail with reference to the drawings in which.

DETAILED DESCRIPTION OF THE PREFERRED EMBODIMENT OF THE INVENTION

Figure 1:
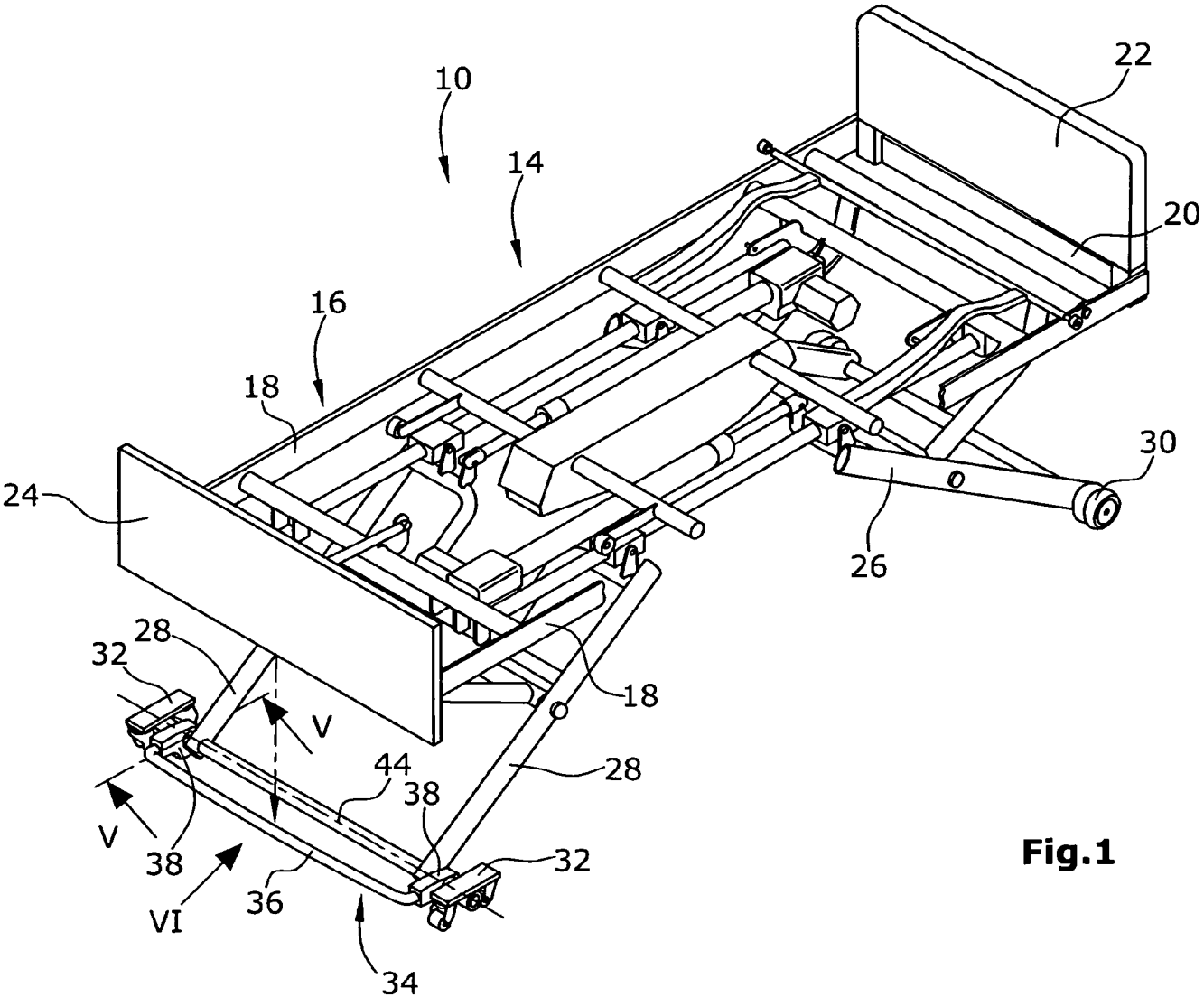
FIG. 1 shows a perspective view of a height-adjustable bed comprising a scissor-type mechanism for height adjustment.

FIG. 1 shows the general configuration of a height-adjustable and movable sickbed or nursing bed 10 comprising a (lower) bedstead portion 12 and provided with an adjustable mattress supporting device 14 (only partly shown in FIG. 1). In this embodiment, the height-adjustable lower bedstead portion 12 is configured as a kind of scissor-type mechanism which is however not critical in the present invention.

In this embodiment, the lower bedstead portion 12 comprises a frame 16 having frame side parts 18 and frame transverse parts 20 where a head end 22 and a foot end 24 are located. Below the frame 16, pivotably supported and guided legs 26,28 are arranged which comprise casters 30 and guide rollers 32, respectively, at their lower ends. In the region of the guide rollers 32, which, in this embodiment, are arranged at the legs 28 associated with the foot end 24, a fixing brake 34 is disposed which comprises an actuator configured as an actuating bar 36 at which two brake elements 38 made of rubber are arranged and which is supported at the legs 28 in such a manner that it is pivotable about an axis 44.

Figure 2:
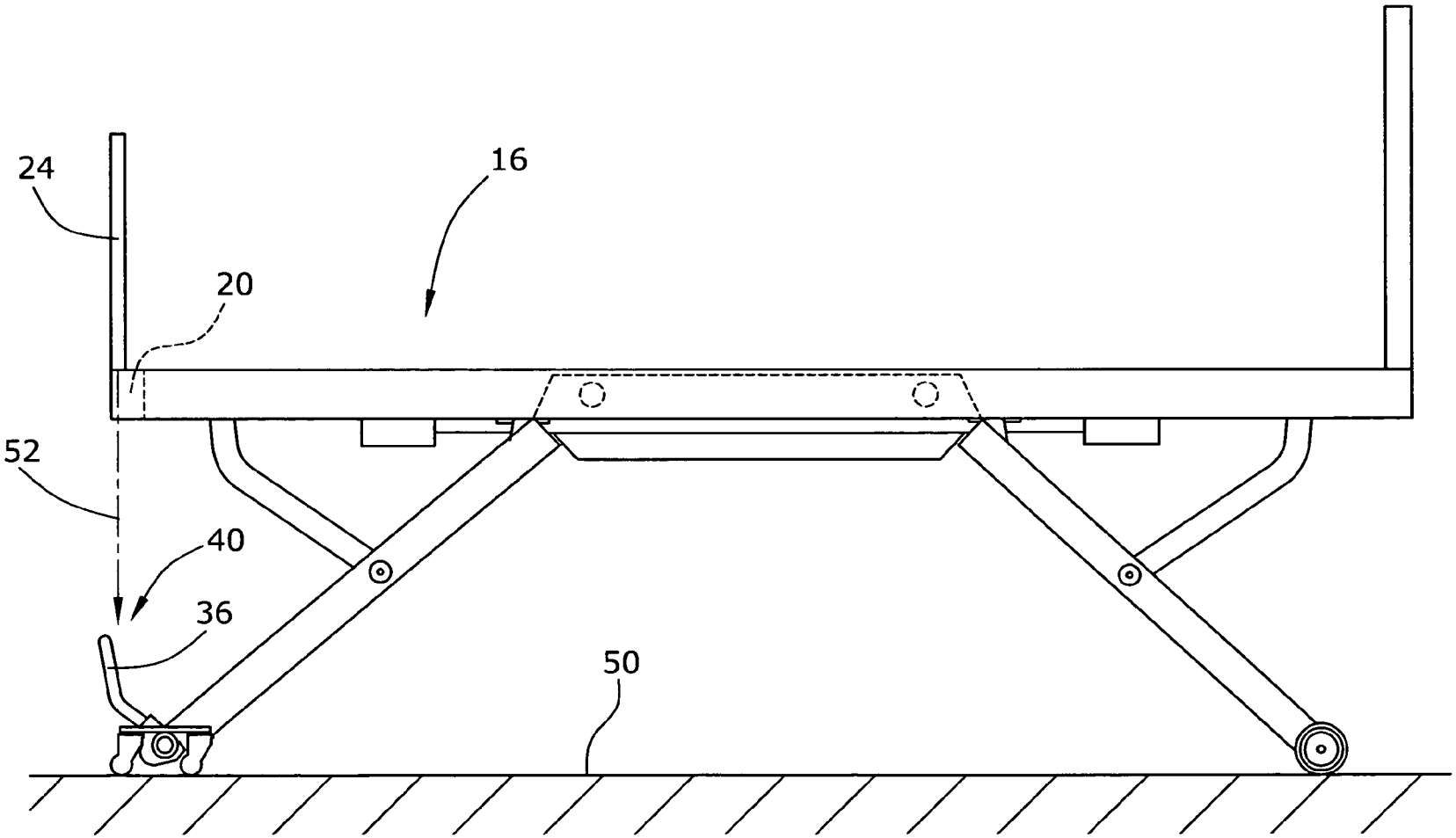
FIG. 2 shows a side view of the height-adjustable bed in a lifted position and with released fixing brake.
Figure 3:
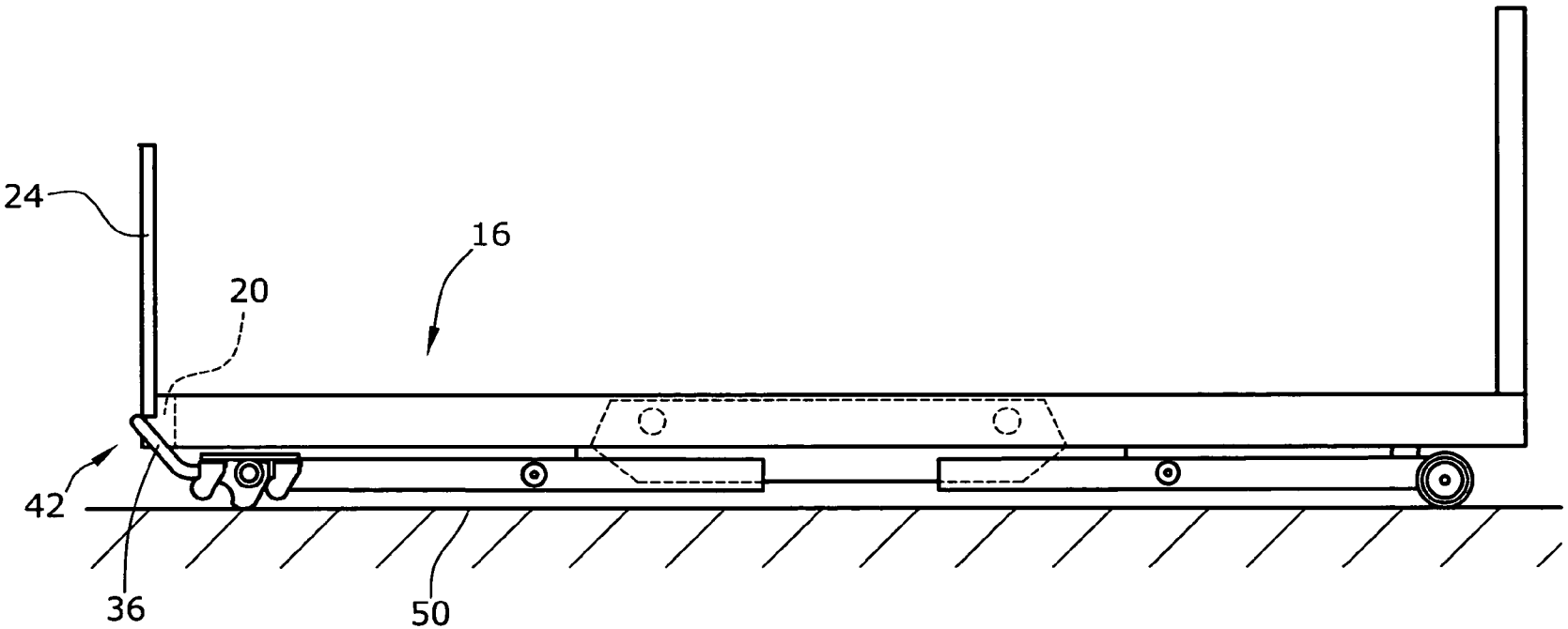
FIG. 3 shows side view of the bed in the completely lowered condition and with automatically activated fixing brake.
Figure 4:
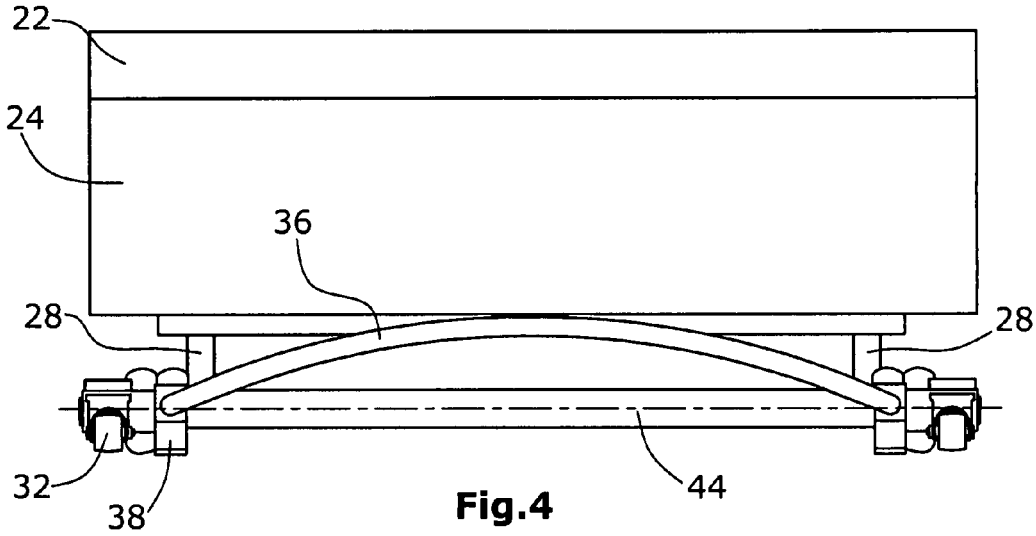
FIG. 4 shows a view of the fixing brake in the direction indicated by arrow V of FIG. 1, and FIGS. 5 and 6 show sectional views along line V-V of FIG. 1 for illustrating the position of the fixing brake and the castors of the bed with released fixing brake and activated fixing brake (braking condition), respectively.

FIGS. 2 and 3 show that the actuating bar 36 is pivotable between a release position (FIG. 2) and a braking position (FIG. 3).

Figure 5:
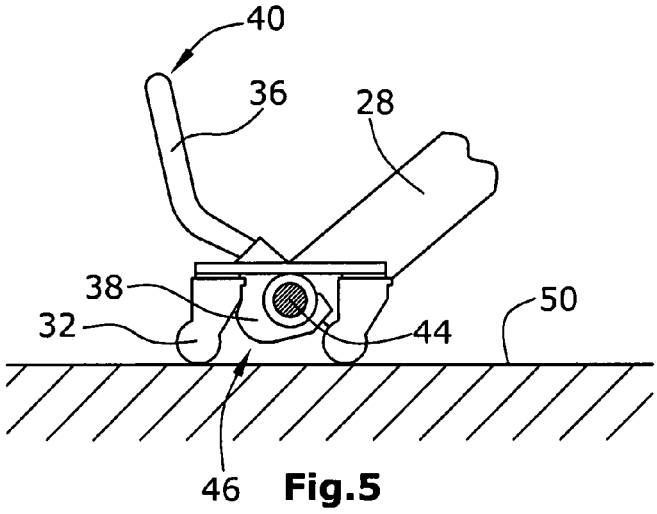
Figure 6:
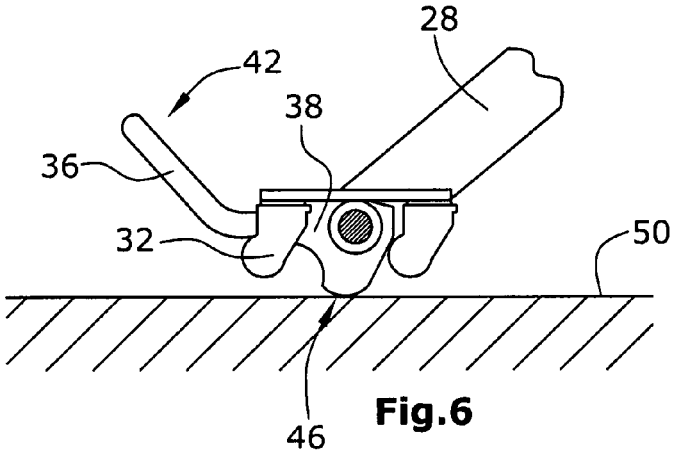

As can in particular be seen in FIGS. 5 and 6, the braking elements 38 are eccentrically supported in such a manner that they are rotatable about an axis 44. The brake elements 38 comprise a bulge 46 which, depending on the position of the actuating bar 36, is either located above a floor 50 (see FIG. 5—release position) or pressed to the floor 50 (see FIG. 6—braking position). In the position shown in FIG. 6, the guide rollers 32 are lifted with respect to the floor 50 such that the bed 10 rests on the brake elements 38.

FIGS. 2 and 3 show that the actuating bar 36 in its release position 42 (see FIG. 2) is located in the path 52 along which the rear frame traverse part 20 or foot end 24 or another element of the frame 16 moves during the height adjustment operation, for example. In some embodiments, the actuating bar 36 is adapted to be automatically placed into the braking position (see FIG. 6) by a bedstead element, such as the rear frame traverse part 20, foot end 24 or another element of the bedstead portion 12, when the lowermost position of the bedstead portion 12 has been reached.

Although the invention has been described and illustrated with reference to a specific illustrative embodiment thereof, it is not intended that the invention be limited to this illustrative embodiment. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

What is claimed is:

1. A bed, in particular a sickbed or nursing bed, comprising a height-adjustable bedstead to be supported on a floor, a fixing brake comprising an actuator adapted to be moved between a braking position and a release position and to be operated by hand or by foot, and at least one brake element which is pressed to the floor in the braking position of the actuator, and is spaced apart from the floor in the release position of the actuator, wherein the actuator is adapted to be automatically placed into the brake position by a bedstead element when the lowermost position of the bedstead has been reached.

2. The bed according to claim 1, wherein the bedstead comprises a frame and length-adjustable and/or pivotable legs supported at said frame, wherein the at least one brake element is arranged at least one of the legs or between two legs, and wherein the actuator, in its release position, extends into a path along which the bedstead element moves when the bedstead is lowered into the lowermost position.

3. The bed according claim 2, wherein the actuator is mechanically coupled to the brake element via a knee lever mechanism.

4. The bed according to claim 1, wherein the bedstead comprises castors, and wherein at least one of the castors is lifted with respect to the floor when the brake element is pressed to the floor.

5. The bed according to claim 4, wherein the actuator is mechanically coupled to the brake element via a knee lever mechanism.

6. The bed according to claim 1, wherein the actuator is mechanically coupled to the brake element via a knee lever mechanism.

* * * * *